United States Patent [19]

Dankel

[11] Patent Number: 4,515,194

[45] Date of Patent: May 7, 1985

[54] LOG SPLITTER HAVING SERVICEABLE WEDGE ASSEMBLY

[75] Inventor: Douglas D. Dankel, Kankakee, Ill.

[73] Assignee: Roper Corporation, Kankakee, Ill.

[21] Appl. No.: 506,035

[22] Filed: Jun. 20, 1983

[51] Int. Cl.[3] ..... B27L 7/00

[52] U.S. Cl. ..... 144/193 A; 144/193 E; 407/70

[58] Field of Search ..... 407/31, 70; 144/3 K, 144/366, 193 R, 193 A, 193 D, 193 E

[56] References Cited

U.S. PATENT DOCUMENTS

| | | | |
|---|---|---|---|
| 259,010 | 6/1882 | Hall . | |
| 845,954 | 3/1907 | Hildreth . | |
| 846,838 | 3/1907 | Fannon . | |
| 1,441,996 | 1/1923 | Mukai . | |
| 2,839,105 | 6/1958 | Ganterbine | 144/194 |
| 3,077,214 | 8/1969 | Brukner | 144/193 |
| 4,061,168 | 12/1977 | Farris, Jr. | 144/193 R |
| 4,103,724 | 8/1978 | Braid | 144/193 A |
| 4,157,105 | 6/1979 | Gansley | 144/193 A |
| 4,275,778 | 6/1981 | Kotas | 144/193 A |
| 4,293,013 | 10/1981 | Phelps et al. | 144/193 A |

OTHER PUBLICATIONS

Owner's Manual 12.5 Ton Splitting Force Log Splitter Model No., W5300AR, Roper Corp., Kankakee, Ill., Jun. 25, 1982.

*Primary Examiner*—W. D. Bray

*Attorney, Agent, or Firm*—Leydig, Voit, Osann, Mayer & Holt, Ltd.

[57] ABSTRACT

A log splitting apparatus having an elongated frame, a selectively actuatable log moving ram mounted at one end of the frame, and a log splitting wedge assembly mounted at the opposite end of the frame. The wedge assembly includes a plurality of wedge tip sections which are removably mountable in vertically stacked relation and having interlocking lugs and recesses between mating upper and lower sides thereof for maintaining the wedge sections in proper alignment. A base plate is mounted on the frame for receiving and retaining the stack of wedge tip sections in proper orientation on the frame, and an upstanding support is mounted on the frame for vertically supporting the wedge tip sections and serving as a reactionary member for forces exerted on the wedge tip sections during log splitting. The wedge tip sections are further positively secured in mounted position by a vertically disposed clamping bolt threaded engaging the base plate. Such apparatus permits the use of a plurality of identically formed wedge tip sections for use in different sized log splitters, as well as enabling quick and economical replacement of damaged portions of the wedge assembly.

28 Claims, 8 Drawing Figures

LOG SPLITTER HAVING SERVICEABLE WEDGE ASSEMBLY

DESCRIPTION OF THE INVENTION

The present invention relates to log splitters, and more particularly, to log splitters of the type which support a log between a wedge and a selectively movable ram such that upon actuation of the ram the log is forceably moved into engagement with a sharp leading edge of the wedge to effect splitting thereof.

High capacity log splitters have become readily available to the public in recent years through rental outlets. Such log splitters typically are supported at one end by a pair of ground wheels and are provided with a trailer hitch at the other end so that the rental customer may easily transport the log splitter from the rental outlet to his work area. The log splitter is commonly powered by a 5–8 horsepower internal combustion engine which operates a ram actuating moving hydraulic piston for generating up to 12 tons or more of splitting force. Such log splitters are available in a number of sizes or capacities measured, for example, by the size of the wedge used to split the logs. The size, that is, the height, of the wedge may range, for example, from 6–12 inches.

Although this type of log splitter is easily and safely operated by inexperienced users, equipment renters have found that the log splitters are occasionally subject to misuse resulting in the wedge damage. Repair of such devices has been frustrated by the fact that the log splitting wedge typically has been weld mounted to the frame in order to provide sufficient rigidity to withstand the forces incurred during splitting. Moreover, damage to the leading edge of the wedge generally has required replacement of the entire wedge.

Accordingly, a principal object of th present invention is to provide a high capacity log splitter having a readily repairable and replaceable wedge tip.

Another object is to provide a serviceable wedge tip for a high-capacity log splitter as characterized above wherein only the damaged portion of the wedge tip need be replaced.

A further object is to provide an improved wedge for a log splitter that is assembled from low-cost powdered metal parts.

Still another object is to provide a wedge tip assembly that may utilize similar parts in forming various sized wedges, such as a 6-inch wedge, a 9-wedge, or a 12-inch wedge.

Other objects and advantages of the invention will become apparent upon reading the following detailed description and upon reference to the drawings, in which.

Figure 3:
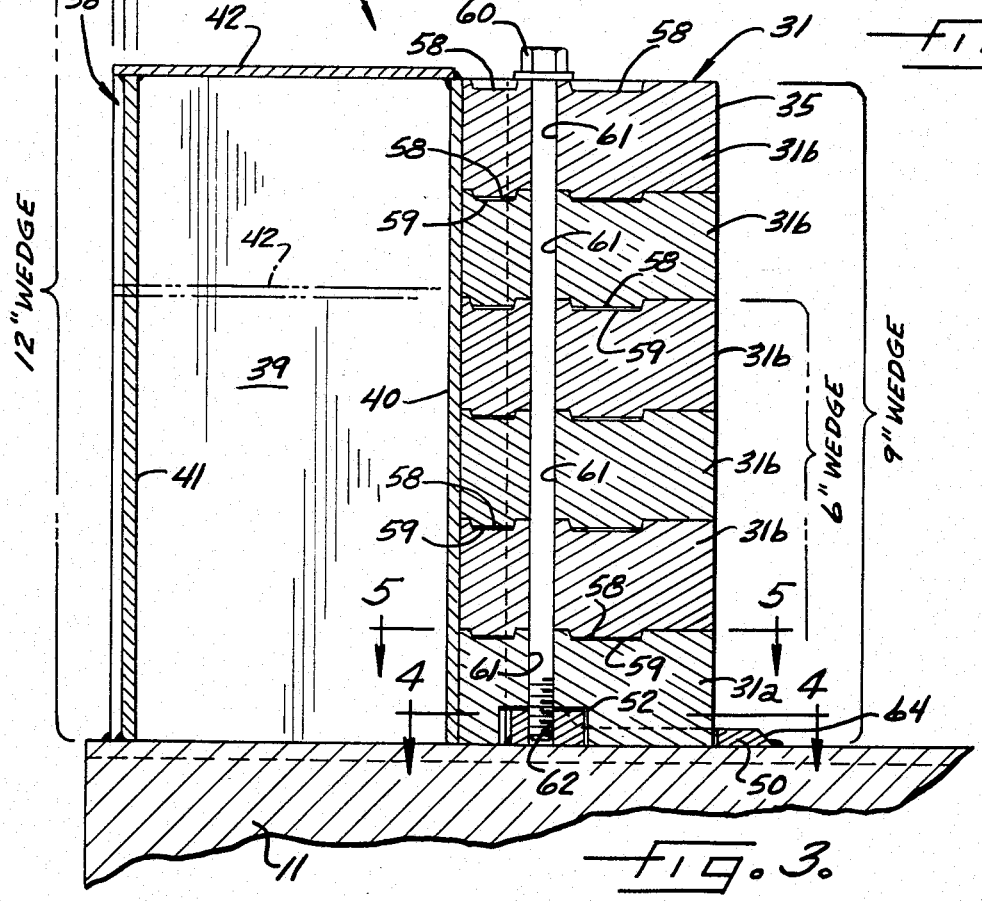
FIG. 3 is a vertical section of the illustrated wedge assembly taken in the plane of line 3—3 in FIG. 2.
Figure 4:
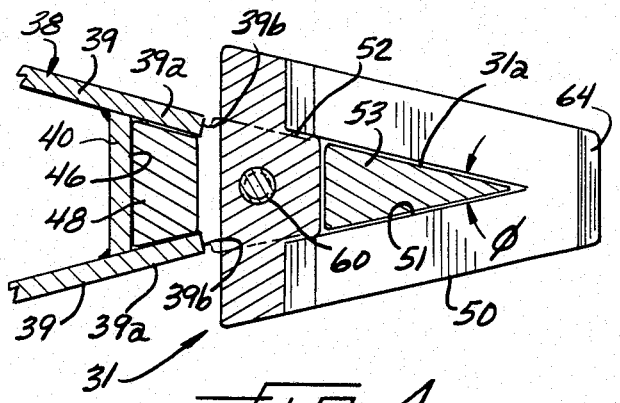
Figure 5:
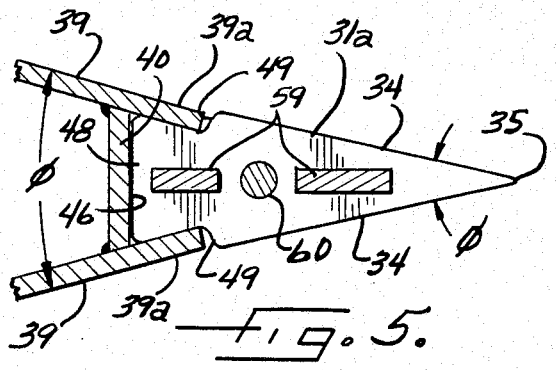
Figure 6:
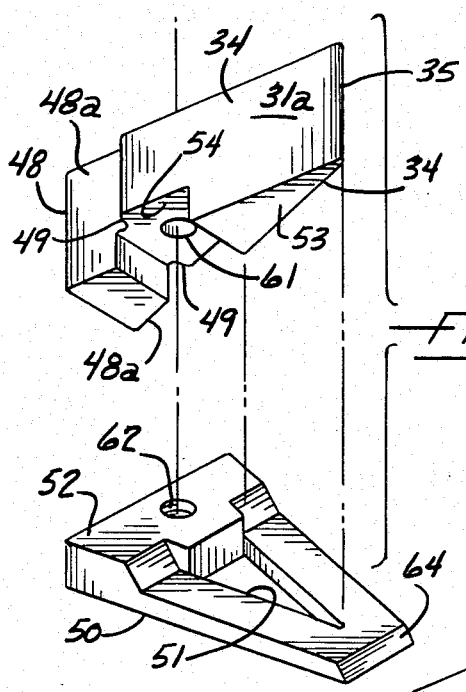
Figure 7:
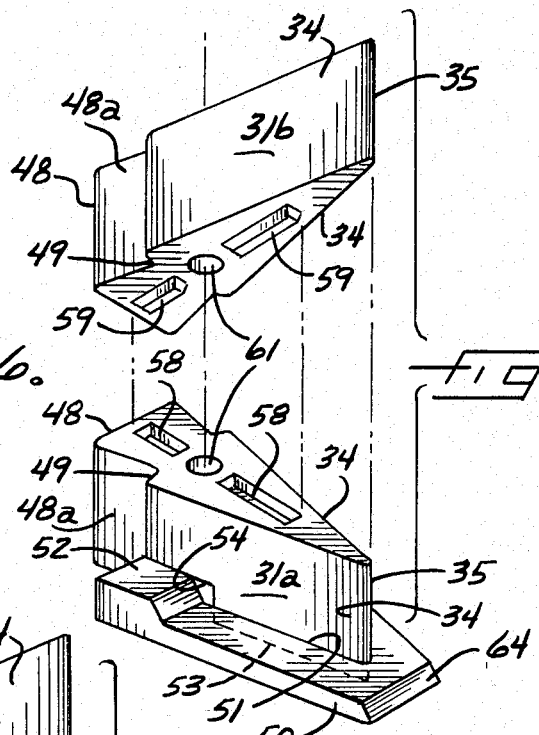
Figure 8:
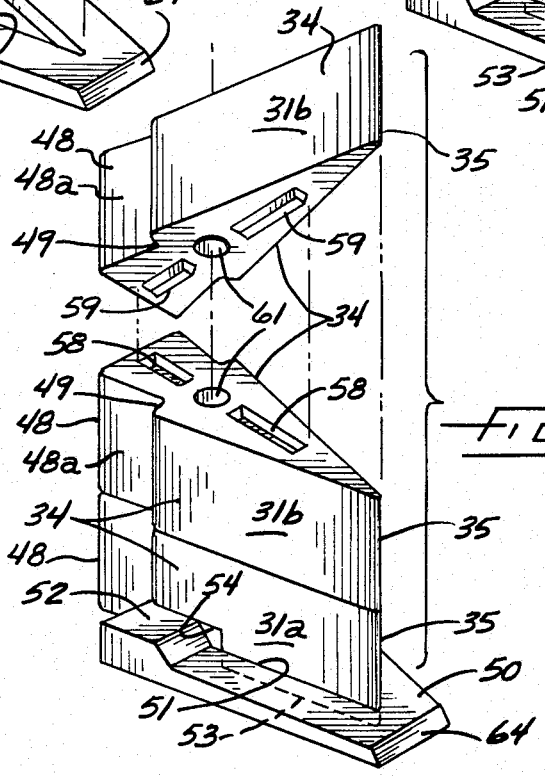

FIGS. 4 and 5 are horizontal sections of the wedge tip of the illustrated wedge assembly taken in the panes of lines 4—4 and 5—5, respectively, in FIG. 3;

FIG. 6 is an exploded perspective showing the assembly of a lower-most wedge section onto the base plate of the illustrated apparatus;

FIG. 7 is an exploded perspective showing the assembly of a second wedge section upon a previously assembled lower-most wedge section; and FIG. 8 is a perspective showing the assemly of a further wedge section onto previously assembled wedge sections.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as defined by the appended claims.

Figure 1:
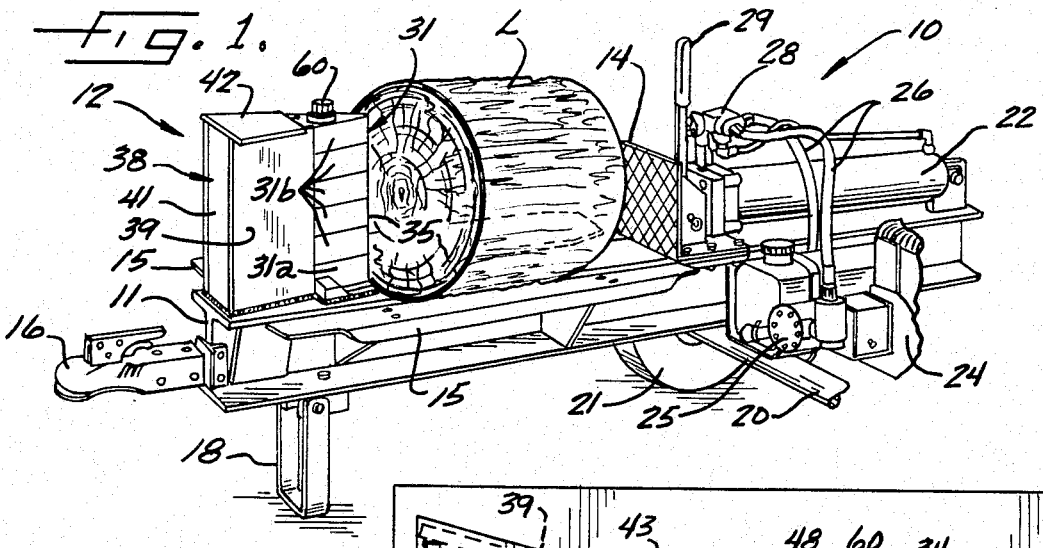
FIG. 1 is a perspective view, in partial section, of an illustrative log splitter embodying the present invention.
Figure 2:
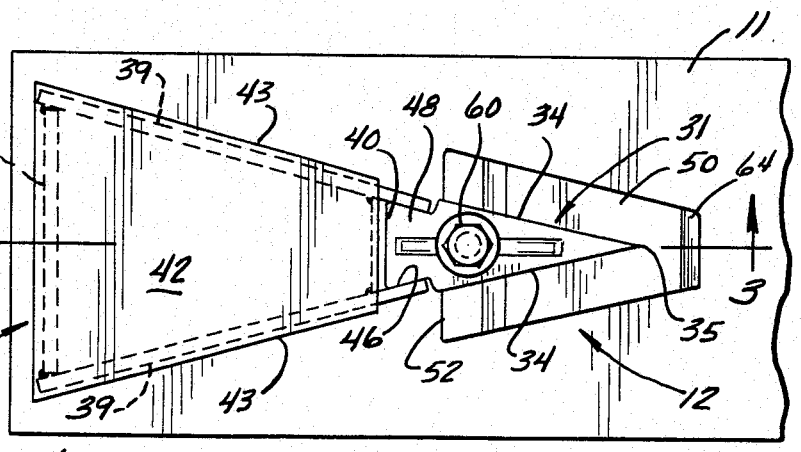
FIG. 2 is an enlarged top plan view of the wedge assembly of the log splitter shown in FIG. 1.

Referring now more particularly to FIG. 1 of the drawings, there is shown an illustrative log splitter 10 embodying the present invention. The log splitter 10 includes an elognated I-beam frame member 11, a central portion of which serves as a support for a log L to be split, and which has a wedge assembly 12 mounted at one end thereof and a log moving ram 14 mounted at the opposite end. To support the log L in proper position on the frame member 11, elongated plates 15 are mounted on opposite sides of the frame member 11, with each plate extending outwardly in a slight upwardly inclined fashion. The end of the frame member 11 adjacent the wedge assembly 12 in this case has an outwardly extending trailer hitch 16 and a stand 18 is pivotably secured to the underside of the frame member 11 adjacent the end thereof such that when positioned in depending fashion, as illustrated, the stand 18 engages the ground and supports the frame member 11 in a substantially horizontal condition. The opposite end of the frame member 11 is supported by a carriage which includes an axial 20 and a pair of ground wheels 21 (only one of which is shown) so as to permit convenient transport of the log splitter 10.

For selectively extending and retracting the ram 14 during a log splitting operation, the ram 14 is fixed to the end of a piston rod of a hydraulic cylinder 22 mounted on the rear end of the frame member 11. To operate the cylinder 22, as internal combustion engine 24, preferably between 5 and 8 horsepower, is mounted at the rear of the log splitter and drives a hydraulic pump 25, which in turn communicates fluid through pressure lines 26 to a manually operated valve 28 controlled by a handle 29. When the valve control handle 29 is moved in one direction, pressurized fluid is directed to the hydraulic cylinder 22 to extend the ram 14 into engagement with a log L mounted on the frame member 11 and thereupon forces the log against the wedge assembly 12 to effect splitting thereof. Upon completion of the splitting operation, the valve control handle 29 may be moved to a position which causes the cylinder 22 to retract the ram 14 and permit positioning of a new log onto log splitter for the next splitting operation.

In accordance with the present invention, the wedge assembly 12 includes a replaceable wedge tip 31 comprising a plurality of vertically stacked interlocking wedge tip section 31*a*, 31*b* which are adapted for secure and properly aligned mounting during use and which are individually removeable and replaceable if damaged. The wedge sections 31*a*, 31*b* each have a pair of wedge faces 34 disposed at a common included angle $\phi$ and which join each other at a leading edge 35 located on the longitudinal axis of the wedge tip section. The wedge tip sections 31*a*, 31*b* may be made from powdered metal for strength and rigidity, and in the illustrated embodiments, the wedge sections 31*b* are identically formed for economical manufacture.

For vertically supporting the wedge tip sections 31*a*, 31*b*, in properly stacked relation, the wedge assembly 12 includes an upstanding support 38 fixed to the frame member 11, such as by welding. The support 38 includes a pair of side plates 39 which are disposed in angular relation with an included angle $\phi$ similar to or greater than the included angle of the wedge faces 34 so as to, in effect, form rearward extensions of the log splitting wedge. To rigidify the upstanding support 38, transverse vertical plates 40, 41 are mounted between the side plates 39 and a top plate 42 is fixed to the top of the support between the transverse plates 40, 41. Outer peripheral sides 43 of the top plate 42 in this instance extend outwardly a distance beyond the side plates 39 of the upstanding support 38 so as to tend to prevent logs from climbing up the wedge assembly 12 during splitting.

In order to retain the wedge tip sections 31*a*, 31*b* in mounted position, the transverse support plate 40 and forward extensions 39*a* of the side plates 39 define a mortice or recess 46. Each of the wedge tip sections 31*a*, 31*b* is formed with a rearward dove-tailed shaped tenon 48 that is positionable in the support recess 46 with the wedge tip faces 34 and leading edge 35 extending forwardly therefrom. The dove tailed tenon 48 in this case is formed with sides 48*a* generally parallel to or angled slightly more than the sides of the wedge tip faces 34, while being inwardly spaced from the faces 34 and connected thereto by respectively outwardly directed shoulders 49 which are oriented in parallel relation to leading ends 39*b* of the upstanding support side plates 39. It will be seen that the wedge sections 31*a*, 31*b* may be assembled in vertically stacked relation by placing the dove-tailed tenon 48 of each wedge section into the complimentary shaped recess 46 of the upstanding support, which retains the wedge section in assembled position with the shoulders 49 in close bearing relation to the forward leading ends 39*b* of the support plates 39. As will become apparent, since the upstanding support 38 is fixed to the frame member 11, it will serve as a reactionary member for forces transmitted to the wedge tip 31 during log splitting. Plate 40 serves as a rearward support for the wedge tip sections 31*a*, 31*b* and carries the bulk of the forces imposed on said wedge tip sections during splitting operations.

For maintaining proper aligned orientation of the wedge tip 31, a base plate 50 is fixed to the frame member 11 for receiving and orienting the lower-most wedge section 31*a* of the assembled stack, and the individual wedge sections 31*a*, 31*b* each have interlocking means on their mating upper and lower surfaces for establishing and maintaining their precise longitudinal alignment. The base plate 50 in this instance is formed with a triangular recess 51 and an upstanding transversely-oriented rear portion 52. The underside of the lower-most wedge tip section 31*a* is formed with a depending triangular shaped forward end 53 for positioning in the base plate recess 51 and a transverse channel-shaped recess 54 for fitting over the raised base plate portion 52, as shown in FIGS. 6 and 7. Mounting of the lower-most wedge section 31*a* onto the base plate 50 with such interengaging means automatically establishes the precise alignment of the wedge section 31*a* on the longitudinal axis of the frame member 11.

For interlocking the individual wedge sections 31*a*, 31*b* of the wedge tip 31 in similar orientation, the top surface of each wedge section 31*a*, 31*b* is formed with a pair of elongated recesses 58 on the longitudinal axis of the wedge section and the underside of each wedge section 31*b* is formed with a pair of complimentary shaped elongated lugs 59 for positioning in the recesses 58 of the wedge section immediately therebelow, as shown in FIGS. 7 and 8. Each of the wedge sections 31*b*, therefore, may be identically formed and selected numbers of such wedge sections vertically stacked to form a wedge tip of desired height. In practice, the wedge sections 31*a*, 31*b* preferably should have thicknesses such that common sized wedge tips may be readily formed by stacking predetermined numbers of such wedge sections. For example, if the wedge sections 31*a*, 31*b* each has a thickness of 1½ inches, a six inch high wedge tip may be formed from four wedge sections, a nine inch high wedge tip may be formed from six wedge sections, and a twelve inch high wedge tip may be formed from eight wedge sections.

To positively secure the assembled stack of wedge sections 31*a*, 31*b* together in order to enable the wedge tip to withstand impact forces during log splitting, a clamping bolt 60 in this case is provided. The clamping bolt 60 extends vertically through commonly oriented aperatures 61 in the respective wedge sections 31*a*, 31*b* and threadebly engages a tapped hole 62 in the upstanding base plate portion 52.

For guiding a log L into contact with the leading edge 35 of the wedge tip 31 during log splitting, the base plate 50 has a beveled leading edge 64 projecting forwardly of the leading edge 35 of the wedge tip. It will appreciated that since the lower-most wedge tip section 31*a* is supported within the base plate recess 51, slivers or chips from split logs will not tend to be forced under the wedge tip, which otherwise could create undesirable and potentially damaging stresses on the wedge assembly.

From the foregoing, it can be seen that the wedge assembly of the present invention lends itself to economical manufacture and assembly, reliable and effective operation, and easy and inexpensive replacement of damaged parts. As shown, the individual wedge sections 31*a*, 31*b* may be easily assembled in the upstanding support 38 to the desired height for different sized log splitters. The leading edges 35 of each of the wedge tip sections 31*a*, 31*b* are automatically disposed in proper longitudinal alignment by virtue of their mounting in the base plate 50 and the interlocking lugs and recesses 58, 59 of the mating wedge tip sections. The clamping bolt 60 is then easily inserted through the assembled stack of wedge tip sections 31*a*, 31*b* and tightened into clamping condition by threaded engagement with the base plate 50. The wedge tip 31 is reliably maintained in such mounted and aligned condition during use, with the base plate forward beveled edge 64 serving to guide logs into engagement with the leading wedge tip edge 35, the top plate 42 limiting upward log movement during splitting, and the upstanding support 38 serving as a reactionary support member for the wedge assembly. In the event of damage to one or more of the wedge sections 31*a*, 31*b*, the clamping bolt 60 may be easily removed, the damaged wedge sections removed and replaced, and the clamping bolt reengaged. Hence, only the damaged wedge tip portion of the wedge assembly need be replaced, and this can be done quickly and economically.

What is claimed is:

1. A log splitting apparatus comprising an elongated frame, selectively actuateable ram means mounted for longitudinal movement on one end of said frame, a wedge assembly mounted on the opposite end of said frame, said wedge assembly including a plurality of wedge tip sections each having a log splitting leading edge on a longitudinal axis thereof and being removably mounted in vertically stacked relation, said wedge tip sections each having interlocking means between mating upper and lower surfaces thereof for maintaining the leading edges of said wedge tip sections in alignment, and means for supporting and retaining said stack of wedge tip sections on said frame with the longitudinal axes thereof parallel to the movement of said ram means.

2. The apparatus of claim 1 in which at least a plurality of said wedge tip sections are identically formed.

3. The apparatus of claim 1 in which said wedge tip section supporting and retaining means includes an upstanding support fixed to said frame, said wedge sections each being removably mounted on said upstanding support with their leading edge extending forwardly thereof such that said upstanding support serves as a reactionary member for forces exerted on said wedge tip sections during log splitting.

4. The apparatus of claim 1 in which wedge tip section interlocking means includes raised lugs and recesses formed on mating upper and lower surfaces of said vertically stacked wedge tip sections.

5. The apparatus of claim 4 in which said raised lugs and recesses are disposed on the longitudinal axes of the wedge tip sections.

6. The apparatus of claim 3 in which said upstanding support defines a forwardly opening recess for receiving and supporting rear portions of said wedge sections.

7. The apparatus of claim 6 in which said upstanding support recess has a dove-tailed cross sectional shape, and the rear portions of said wedge tip sections are shaped to conform to and fit within the support recess.

8. The apparatus of claim 3 in which said wedge tip sections each have forward wedge faces disposed at a common included angle and which converge to define the leading edge of the wedge tip section, and said upstanding support has sides disposed at an angle similar to the angle of said wedge tip faces so as to form a substantially uninterrupted rearward extension of the wedge tip faces.

9. The apparatus of claim 3 in which said upstanding support includes outwardly extending means on the upper peripheral sides thereof for reducing upward log movement during splitting.

10. The apparatus of claim 6 in which said upstanding support includes a pair of side plates fixed to said frame in forwardly converging angular relation to each other, and said wedge tip section receiving recess is defined by forward extensions of said side plates.

11. The apparatus of claim 10 in which each said wedge tip sections has commonly formed forward wedge faces, a rear portion for positioning in the upstanding support recess, and rearwardly facing shoulders between said wedge faces and said rear portion; and said shoulders of each wedge tip section are formed for mounting in substantially parallel bearing relation to the leading edges of said upstanding support side plate extensions.

12. The apparatus of claim 3 in which said wedge tip section supporting and retaining means includes a base plate fixed to said frame, said base plate having means for retaining the angular orientation of the lowermost section of the stack of said wedge tip sections.

13. The apparatus of claim 12 in which said base plate defines a recess for receiving said lower-most wedge tip section.

14. The apparatus of claim 12 in which said base plate has a beveled leading edge portion projecting forwardly of the leading edge of said lowermost wedge tip section for guiding a log into engagement with the wedge tip sections during log splitting.

15. The apparatus of claim 12 in which said wedge tip section supporting and retaining means includes a clamping bolt extending vertically through said wedge tip sections.

16. The apparatus of claim 15 in which said clamping bolt is threadedly engageable with said base plate.

17. The apparatus of claim 12 in which said base plate is formed with a recess and an upstanding portion, said upstanding portion being disposed transverse to said recess, and said lowermost wedge tip section is formed with a depending extension shaped complimentary to said base plate recess for positioning in said recess and a transverse channel for positioning over said base plate upstanding portion.

18. A log splitting apparatus comprising an elongated frame, selectively actuatable ram means mounted on one end of said frame, a wedge assembly mounted on the opposite end of said frame, said wedge assembly including a plurality of wedge tip sections each having a log splitting leading edge and being removably mounted in vertically stacked relation, a base plate mounted on said frame and having means for receiving and retaining the angular orientation of the lowermost wedge tip section of said stack, and upstanding support means mounted on said frame and defining a forwardly opening recess for receiving and supporting rear portions of said wedge sections and serving as a reactionary member for forces exerted on said wedge tip sections during log splitting.

19. The apparatus of claim 18 in which said upstanding support recess has a dove-tail cross sectional shape, and the rear portions of said wedge tip sections are shaped to conform to and fit within the support recess.

20. The apparatus of claim 18 in which said upstanding support includes a pair of side plates fixed to said frame in forwardly converging angular relation to each other, and said wedge tip section receiving recess is defined by forward extensions of said side plates.

21. The apparatus of claim 20 in which said wedge tip sections each have forward wedge faces disposed at a common included angle and which converge to define the leading edge of the wedge tip sections, and said upstanding support side plates are disposed at an angle similar to the angle of said wedge tip faces so as to form a substantially uninterrupted rearward extension of the wedge tip faces.

22. The apparatus of claim 20 in which said wedge tip sections each have forward wedge faces disposed at a common included angle and which converge to define the leading edge of the wedge tip sections, and said upstanding support side plates are disposed at an included angle greater than the included angle of said wedge tip faces, and the sides of the upstanding support form a substantially uninterrupted rearward extension of the wedge tip faces.

23. A log splitting apparatus comprising an elongated frame, selectively actuatable ram means mounted on one end of said frame, a wedge assembly mounted on the opposite end of said frame, said wedge assembly including a plurality of wedge tip sections each having a log splitting leading edge and being removably mounted in vertically stacked relation, a base plate mounted on said frame and having means for receiving and retaining the angular orientation of the lowermost wedge tip section of said stack, and upstanding support means mounted on said frame for supporting said stack of wedge tip sections and serving as a reactionary member for forces exerted on said wedge tip sections during log splitting, said upstanding support means including outwardly extending means on the upper peripheral sides thereof for reducing upward log movement during splitting.

24. A log splitting apparatus comprising an elongated frame, selectively actuatable ram means mounted on one end of said frame, a wedge assembly mounted on the opposite end of said frame, said wedge assembly including a plurality of wedge tip sections each having a log splitting leading edge and being removably mounted in vertically stacked relation, a base plate mounted on said frame and defining a recess for receiving and retaining the angular orientation of the lowermost wedge tip section of said stack, and upstanding support means mounted on said frame for supporting said stack of wedge tip sections and serving as a reactionary member for forces exerted on said wedge tip sections during log splitting.

25. The apparatus of claim 24 in which said base plate has a beveled leading edge portion projecting forwardly of the leading edge of said lowermost wedge tip section for guiding a log into engagement with the wedge tip sections during log splitting.

26. A log splitting apparatus comprising an elongated frame, selectively actuatable ram means mounted on one end of said frame, a wedge assembly mounted on the opposite end of said frame, said wedge assembly including a plurality of wedge tip sections each having a log splitting leading edge and being removably mounted in vertically stacked relation, said wedge tip section each having interlocking means between mating upper and lower surfaces thereof for maintaining the leading edges thereof in alignment, a base plate mounted on said frame and having means for receiving and retaining the angular orientation of the lowermost wedge tip section of said stack, and upstanding support means mounted on said frame for supporting said stack of wedge tip sections and serving as a reactionary member for forces exerted on said wedge tip sections during log splitting.

27. The apparatus of claim 26 in which wedge tip section interlocking means includes raised lugs and recesses formed on mating upper and lower surfaces of said vertically stacked wedge tip sections.

28. The apparatus of claim 26 in which said wedge tip sections each have forward wedge faces disposed at a common included angle and which converge to define the leading edge of the wedge tip section, and said upstanding support has sides disposed at an included angle greater than the included angle of said wedge tip faces, and the sides of the upstanding support form a substantially uninterrupted rearward extension of the wedge tip faces.

* * * * *